US006253927B1

(12) United States Patent
Väänänen et al.

(10) Patent No.: US 6,253,927 B1
(45) Date of Patent: Jul. 3, 2001

(54) ROLLER SCREEN

(75) Inventors: Eero Väänänen; Martti Jankkila; Lauri Mustikka; Pekka Rantala, all of Tornio (FI)

(73) Assignee: Outokumpu Technology Oy, Espoo (FI)

( * ) Notice: Subject to any disclaimer, the term of this patent is extended or adjusted under 35 U.S.C. 154(b) by 0 days.

(21) Appl. No.: 09/331,285

(22) PCT Filed: Dec. 22, 1997

(86) PCT No.: PCT/FI97/00830

§ 371 Date: Aug. 23, 1999

§ 102(e) Date: Aug. 23, 1999

(87) PCT Pub. No.: WO98/29201

PCT Pub. Date: Jul. 9, 1998

(30) Foreign Application Priority Data

Dec. 30, 1996 (FI) ..... 965255

(51) Int. Cl.[7] ..... B07B 13/05
(52) U.S. Cl. ..... 209/668; 209/673
(58) Field of Search ..... 209/659, 660, 209/667, 668, 673

(56) References Cited

U.S. PATENT DOCUMENTS 3,438,491 * 4/1969 Haley et al. ..... 209/673
4,627,541 * 12/1986 Johnson ..... 209/668
5,890,600 * 4/1999 Laatikainen ..... 209/673 X

FOREIGN PATENT DOCUMENTS

1729615 * 4/1992 (SU) ..... 209/673

* cited by examiner

*Primary Examiner*—Tuan N. Nguyen
(74) *Attorney, Agent, or Firm*—Morgan & Finnegan LLP

(57) ABSTRACT

The invention relates to a roller screen for screening pellets for sintering, the roller screen including several successive rotating rollers that are spaced apart and arranged transversally in relation to the proceeding direction of the material. The roller screen is provided with separate rotation motors for rotating each of the rollers and an adjusting member for adjusting the mutual position of the rollers in order to screen a desired particle size. The screen path of the roller screen is composed of three successive screening parts, which are mutually connected so that the rollers of the screening parts are made to rotate in relation to each other, and the speed of rotation of the roller increases in the proceeding direction of the material towards the final end of the roller screen.

5 Claims, 2 Drawing Sheets

ROLLER SCREEN

Figure 1:
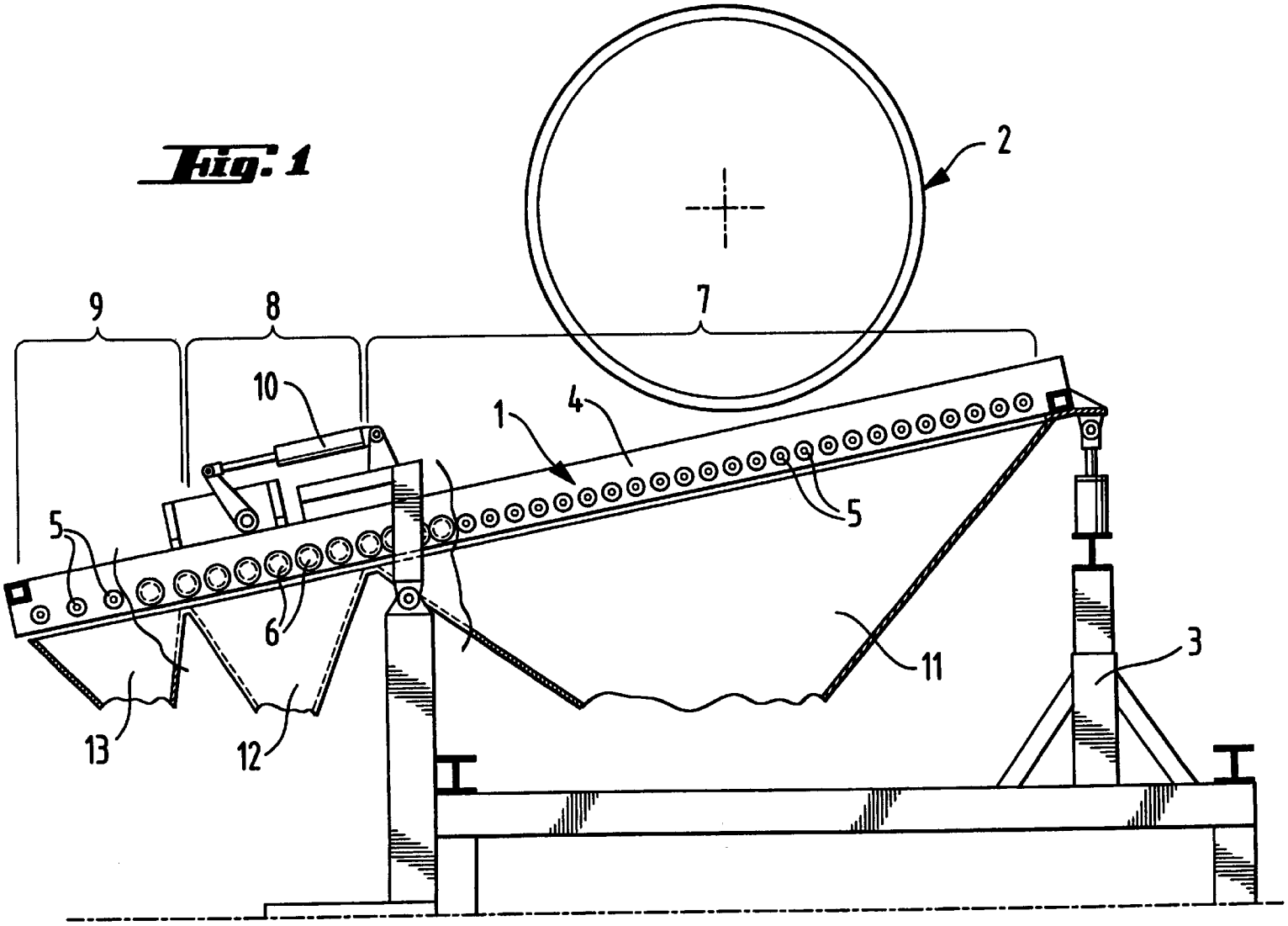

The present invention relates to a roller screen comprising several successive, rotating rollers that are spaced apart and set transversally with respect to the proceeding direction of the material. In particular, the invention relates to a roller screen designed for screening pellets to be sintered, wherein the pellets that are too small and too large in cross-section are screened off the sintering furnace feed.

Many material treating processes require that from the finely divided material to be processed, there is removed for instance the coarsest and the finest particles, so that the material obtained to be processed is formed of particles with a size essentially between two determined limit values. Thus the obtained material essentially conforms to a desired size. Consequently, several different screens are developed for screening material in order to obtain a lump size that is advantageous for the next processing step. Normally the screens are arranged in an inclined position, so that the material to be screened passes over the screen by gravitation, or the screens are provided with vibrator devices, so that the material is made to move on the screen.

In addition to this, many smelting processes require that the material to be smelted is not too finely divided, and therefore a finely divided material, such as concentrate, must first be pelletized and thereafter sintered in order to improve the strength of the pellets. However, the capacity of the sintering furnace is dependent, among others, on the size of the pellets fed therein. Therefore there is normally arranged a roller screen in between the pelletizing device and the sintering furnace, which roller screen separates the smallest pellets from the sintering furnace feed and returns them to pelletizing in order to increase their particle size and hence the capacity of the sintering furnace. This type of roller screen is described for example in the Fl patent 56,131, which includes several rotating transversal rollers in succession. By means of said rotating rollers, the material is made to pass over the screen. Moreover, the roller screen according to the Fl patent 56,131 can be adjusted so that in the proceeding direction of the material, the distance between the rollers grows in order to adjust the screen overflow, so that essentially all pellets constituting the overflow are larger than the pellets that were separated and returned to pelletizing. Thus, in the roller screen according to the Fl patent 56,131, oversized pellets are not screened off the sintering furnace feed, wherefore the size of the feed pellets varies within a wide range. In addition, according to the Fl patent 56,131, the rollers are rotated by means of a chain, and the speed of rotation is regulated roller group by roller group. Furthermore, the rollers are installed above the screen frame, so that concentrate is gathered in the frame structure, and the roller spaces are easily choked.

The object of the present invention is to eliminate some of the drawbacks of the prior art and to achieve an improved roller screen which is more reliable in operation, by which the obtained pelletized material to be screened is in its average size advantageous for the next process step. The essential novel features of the invention are apparent from the appended claims.

According to the invention, the roller screen is composed of three separate screening parts. In the first screening part, the roller spaces are adjusted so that all pellets that are smaller than the desired size are removed from the material to be screened. In the second screening part the roller spaces are adjusted so that the size of the screen underflow to be removed from the material to be screened can be altered essentially rapidly when necessary, and thus the average size of the pellets to be fed further in the sintering furnace can be adjusted. In the third screening part, the rollers are advantageously installed in a stationary fashion, so that the pellets to be fed into the sintering furnace are advantageously applied onto a conveyor located underneath the screen, to form an essentially even layer. In this third screening part, the screen underflow is a pellet on its way to the next process step, i.e. to sintering, whereas the pellets that surpass the desired size and are obtained as the screen overflow are sent back to pelletizing after crushing. The rollers of the screening parts in the roller screen according to the invention are advantageously installed underneath the frame of the roller screen, so that for instance a single damaged roller can be easily replaced by a new, undamaged one when necessary.

In the roller screen according to the invention, the speed of rotation of the rollers is advantageously adjusted, so that the speed of rotation advantageously grows in the proceeding direction of the material, towards the final end of the roller screen. Thus the material layer to be screened becomes thinner, and the screening accuracy becomes remarkably better. At the same time, the rollers of the roller screen advantageously improve the quality of the pellet surfaces prior to sintering. In order to adjust the speed of rotation of the rollers, each roller is provided with a separate rotation motor. Advantageously the rotation motor is pressure compensated and hydraulically operated. Owing to these separate rotation motors, the speed of each roller can be adjusted. Thus the mutual speed of the rollers can be adjusted to be for instance such that the roller speed increases in the proceeding direction of the material, towards the final end of the roller screen. Consequently, the speed of rotation of the rollers is highest in the third screening part, and in the second screening part it is higher than in the first screening part.

The placing of the roller screen rollers underneath the roller screen frame according to the invention also results in that the roller spaces are easily adjusted in order to divide the material to be screened into desired particle sizes. In the first screening part, where the finest element of the material to be screened is removed, the adjusting of the roller spaces is advantageously carried out manually. The adjusting can also be carried out automatically, if so desired. When the roller spaces are adjusted to be of the desired size, the rollers can be permanently installed in a desired position with respect to each other. In the second screening part, the roller space is advantageously adjusted by means of an adjusting member that can be controlled either manually or automatically. The adjusting member as such can be operated pneumatically, hydraulically or electrically. By means of this adjusting member, the operation of the screen can advantageously be regulated essentially rapidly by increasing or reducing the average size of the pellets that are proceeding to the next process step. In the third screening part, the roller space is advantageously adjusted manually, so that the pellets of the desired size are made to set on the conveyor located underneath the roller screen as an essentially even layer in order to obtain an advantageous weighing result. If desired, the adjusting of the roller space in the first and third screening part can also be performed automatically by means of a similar adjusting member as in the second screening part.

Figure 2:
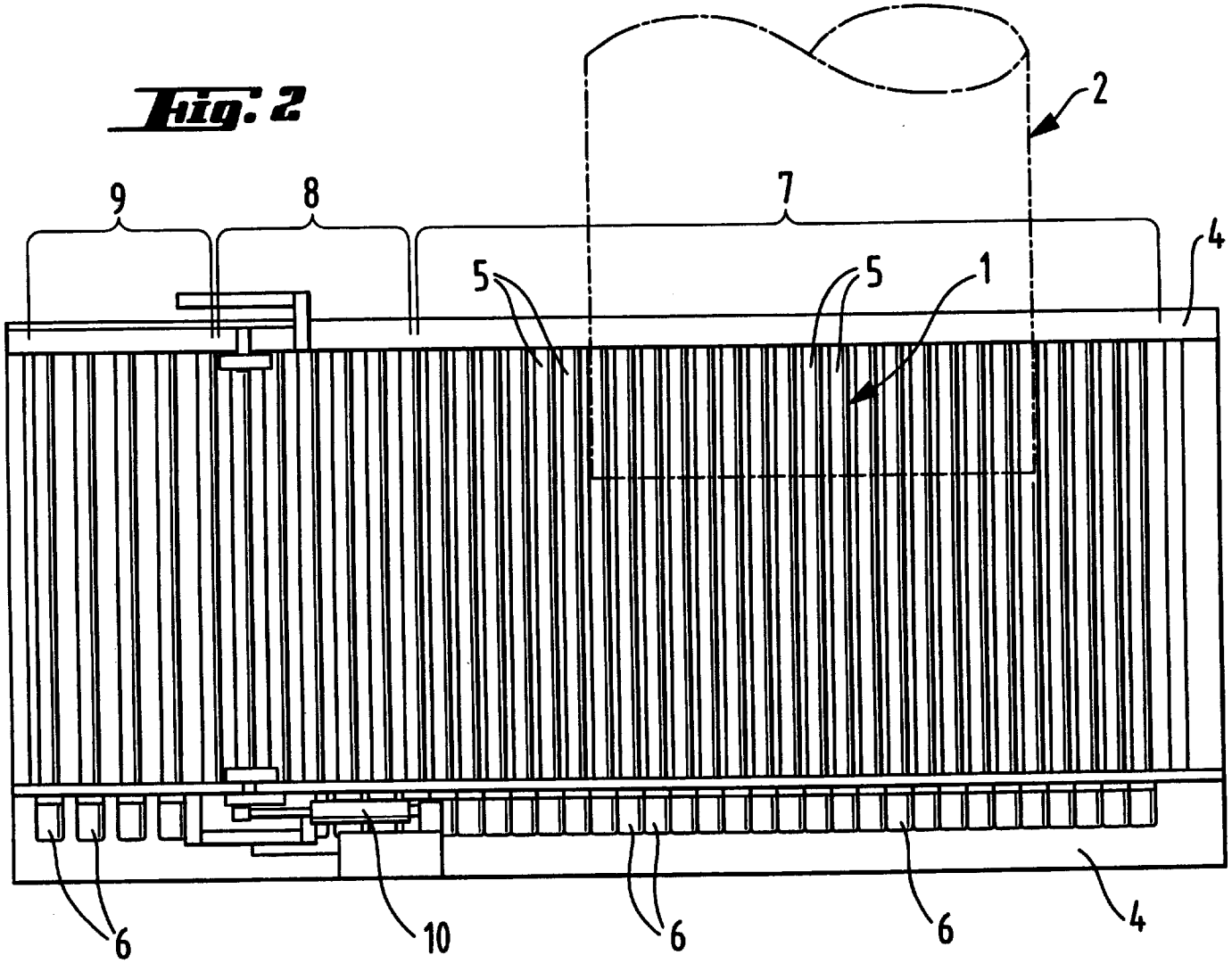

The invention is explained in more detail below, with reference to the appended drawing wherein FIG. 1 shows a preferred embodiment of the invention, seen in partial side-view cross-section, and FIG. 2 is a top-view illustration of the embodiment of FIG. 1, seen in partial cross-section.

According to FIG. 1, the roller screen 1 is installed, with respect to the pelletizing drum 2, so that the pellets discharged from the pelletizing drum 2 fall on the roller screen 1 which is arranged essentially in an inclined position. The roller screen 1 is supported by supporting structures 3, on which the frame structure 4 proper of the roller screen 1 is installed. The frame structure 4 is further provided with rollers 5, so that the rollers 5 are located underneath the frame structure 4. Each of the rollers 5 is provided with a separate rotation motor 6, by which the speed of rotation of an individual roller 5 can be adjusted. In order to adjust the desired roller space, the rollers of the second screening part 8 are provided with their own pneumatic cylinder 10, which adjusts the position of an individual roller with respect to the rest in order to achieve the desired roller space.

At the first end of the roller screen 1, in the flowing direction of the material, the pellets are screened in the first screening part 7 in order to separate such pellets that are too small in diameter and unsuitable for sintering. The underflow of the first screening part, i.e. the pellets that are too small, drop in between the rollers 5 to a funnel 11, and they are returned as feed to the pelletizing drum 2. In the second screening part 8, the clearance of the rollers 5 is adjusted to be larger, which advantageously helps towards obtaining the desired pellet size. In the third screening part 9, the pellets that are good for sintering and have a diameter of roughly 10–15 mm, drop into a funnel 12 as an underflow of the third screening part 9. On the other hand, the overflow of the third screening part, i.e. those pellets that are oversized for pelletizing, are conducted to a funnel 13, from which they are returned, after crushing, to the pelletizing process.

What is claimed is:

1. A roller screen for screening pellets for sintering, comprising several rotating rollers of essentially equal diameters installed in succession at given clearances and arranged transversally in relation to the proceeding direction of material that is placed on the rollers to be screened, a separate rotation motor for rotating each roller, and an adjusting member for adjusting the mutual position of the rollers in order to screen a desired particle size, the screen path of the roller screen including three successive screening parts installed on the same level, which are mutually connected so that each roller of the screening parts is provided with a separate rotation motor, and the speed of rotation of a roller increases in the proceeding direction of the material towards the final end of the roller screen, the spaces between rollers being separately adjustable in the different screening parts, the second screening part being used to adjust the average size of pellets that are fed for sintering through the third screening part.

2. A roller screen according to claim 1, wherein the screening parts are all connected to the same frame structure.

3. A roller screen according to claim 1 or 2, wherein the rollers of the screening parts are installed, in relation to the frame structure, underneath said frame structure.

4. A roller screen according to claims 1, 2 or 3, wherein the spaces between rollers in the screening parts are separately adjustable by the adjusting member.

5. A roller screen according to claim 3, wherein the spaces between rollers in the screening parts are separately adjustable by the adjusting member.

* * * * *